United States Patent [19]

Fraser, Jr. et al.

[11] 3,947,716

[45] Mar. 30, 1976

[54] FIELD EMISSION TIP AND PROCESS FOR MAKING SAME

[75] Inventors: Donald L. Fraser, Jr., Laurel; Bruce Perger, Glen Burnie, both of Md.

[73] Assignee: The United States of America as represented by the Secretary of the Army, Washington, D.C.

[22] Filed: Aug. 27, 1973

[21] Appl. No.: 392,147

[52] U.S. Cl. ..... 313/336; 29/25.17; 427/77; 427/78

[51] Int. Cl.[2] ..... B05D 5/12; H01J 19/10

[58] Field of Search ..... 117/227, 213, 221; 313/337, 346 R, 336; 427/78, 77, 319, 13, 328; 29/25.17

[56] References Cited

UNITED STATES PATENTS

| | | | |
|---|---|---|---|
| 3,374,386 | 3/1968 | Charbonnier et al. | 313/346 R |
| 3,817,592 | 6/1974 | Swanson | 313/336 |

OTHER PUBLICATIONS

Swanson; L. W. et al., *Angular Confinement of Field Electron and Ion Emission*, In Journal of Applied Physics. 40(12): p. 4741–4749. Nov., 1969.

Bettler; P. C. et al., *Activation Energy for the Surface Migration of Tungsten in the Presence of a High-Electric Field.* In Physical Review. 119(1): p. 85–93. July 1, 1960.

*Primary Examiner*—Cameron K. Weiffenbach
*Attorney, Agent, or Firm*—John R. Utermohle; Thomas O. Maser

[57] ABSTRACT

A field emission tip on which a metal adsorbate has been selectively deposited, and a method by which it may be manufactured. In a vacuum, a clean field emission tip is subjected to heating pulses in the presence of an electrostatic field to create thermal field buildup of a selected plane. Emission patterns from the selected plane are observed, and the process of heating the tip within the electrostatic field is repeated until emission is observed from the desired plane. The adsorbate is then evaporated onto the tip. The tip constructed by this process is selectively faceted, with the emitting planar surface having a reduced work function and the non-emitting planar surfaces having an increased work function. A metal adsorbate deposited on the tip so prepared results in a field emitter tip having substantially improved emission characteristics.

7 Claims, 4 Drawing Figures

○ TUNGSTEN CRYSTAL ATOM

○ TUNGSTEN CRYSTAL ATOM

⊘ TUNGSTEN ATOM DISPLACED BY SURFACE MIGRATION

○ TUNGSTEN CRYSTAL ATOM

⊘ TUNGSTEN ATOM DISPLACED BY SURFACE MIGRATION

○ TUNGSTEN CRYSTAL ATOM

⊘ TUNGSTEN ATOM DISPLACED BY SURFACE MIGRATION

● ADSORBED ZIRCONIUM ATOM

FIELD EMISSION TIP AND PROCESS FOR MAKING SAME

BACKGROUND OF THE INVENTION

The present invention relates generally to field emission tips, and more particularly to field emission tips upon which a metal adsorbate has been selectively deposited.

Field emission sources capable of emitting highly focused electron beams, such as are used in scanning electron microscopes, are commonly made from a single tungsten crystal. As shown in the article "Angular Confinement of Field Electron and Ion Emission," by L. W. Swanson and L. C. Crouser, *Journal of Applied Physics*, Vol. 40, No. 12, Nov 1969, pp 4741–4749, coating the emission tip with a metal adsorbate, such as zirconium, will greatly increase the emission from the tip. Because such a coating process requires a very low vapor pressure environment, however, such coatings are not commercially feasible. Additional problems from such coatings arise because certain planes of a body-centered cubic crystal, such as tungsten, have a lower surface density of atoms than others. The lower work function of these lower density planes results in greater adsorption on these planes than on the more closely packed planes. If these low density surfaces are not the ones from which emission is desired, the quality of results is diminished.

A second procedure for improving the emission characteristics of a tungsten field emitter, also described in the above article, is by the use of thermal field buildup. Procedures have been developed by which faceting of selected planes may be produced with a resulting reduction in both angular dispersion of emissions from the tip and reduced beam voltage necessary for emission. However, such emitters are highly susceptible to temperature changes, and tend to be relatively unstable. Additionally, they are very susceptible to ion bombardment and thus require a very high vacuum for effective operation.

It is desired to have a coated tip which can be produced and operated at a commercially feasible vapor pressure, which has improved stability characteristics, and which has both reduced angular beam dispersion and increased brightness over field emitters currently available.

SUMMARY OF THE INVENTION

The present invention uses a novel combination of known procedures to produce an emitter tip having substantially improved performance and which may be produced in an unexpectedly high vapor pressure environment.

Field emitters are commonly made by chemically etching a single crystal of tungsten to produce a tip having a radius on the order of 500 angstroms. The emission quality of such a tip may be greatly enhanced by altering the molecular structure of the tungsten tip to lower the work function of the planes where increased adsorption is desired, and increasing the work function in regions where less adsorption is desired. Such a molecular alteration may be accomplished with thermal field buildup by subjecting the emitter tip to heating pulses in the presence of an electrostatic field to cause surface migration of the tip atoms along field lines. By evaporating, in a vacuum, a metal adsorbate such as zirconium onto a tip prepared in this manner, an emitter having significantly increased brightness and resolution is obtained. A primary advantage of the molecular alteration is that the evaporation may be successfully accomplished in a commercially feasible vapor pressure. An emitter tip having the desirable qualities described above may be produced by placing an etched tip of crystalline material in a suitable vacuum, flashing the tip in the presence of an electrostatic field until the tip is clean, creating an electrostatic field around the tip, flashing the tip in the presence of the electrostatic field until emission is observable from the desired plane and evaporating an adsorbate onto the tip.

Accordingly, it is an object of this invention to produce a new and improved field emission tip.

It is another object to produce an emitter tip upon which a metal adsorbate has been selectively deposited.

A related object of this invention is to produce an emitter capable of emitting an electron beam of high resolution.

Another related object is to produce an emitter tip with increased brightness.

A further object is to provide a method by which emitter tips may be selectively coated at commercially feasible vapor pressures.

It is also an object to produce an emitter tip having reduced surface migration from the emission surface.

Other objects and many of the intended advantages of this invention will be readily appreciated as the invention is better understood by reference to the description below, when taken in conjunction with the accompanying diagrams wherein:

DESCRIPTION OF THE PREFERRED EMBODIMENT

The process to be described must be carried out in a vacuum to prevent contamination of the emitter tip by adsorption of undesired molecules. While the results of the process continue to improve as the vacuum is increased, effective field emitter tips have been produced at a vapor pressure of $1 \times 10^{-8}$ Torr. A suitable vacuum for the process is thus one having a vapor pressure of $1 \times 10^{-8}$ Torr or lower.

Figure 1:
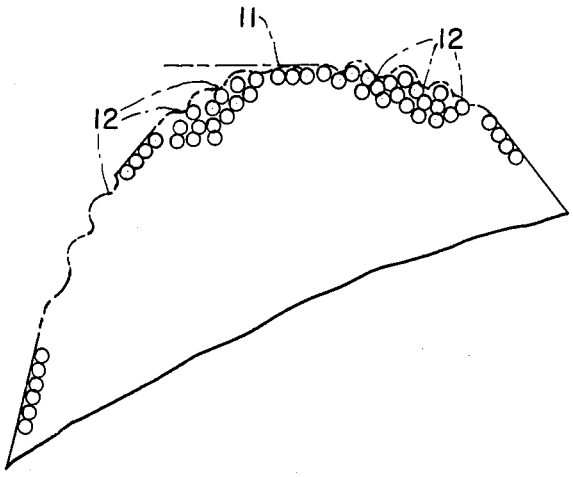
FIG. 1 is a schematic cross section of a field emitter tip showing atomic structure before surface migration.

Referring to FIG. 1, the numeral 11 denotes the (100) plane of an emitter tip composed of tungsten atoms symmetrically oriented into a single crystal. Tungsten has been found to work effectively, but it is not intended that the emitter or the process be limited to the use of this material. Other metals having crystalline structure such as nickel, iridium and molybdenum may also be used with varying degrees of success. The (100) oriented crystal has been chemically etched by ordinary commercial methods to produce a tip having a radius on the order of 500 angstroms. The (100) orientation is preferred on a body-centered-cubic crystal such as tungsten because the (100) planes are 90° apart. Beam resolution is thereby improved because the greater physical distance of similarly oriented planes from the tip's apex substantially confines emission to the desired emitting plane located there. It is not, however, a requirement that the tip be (100) oriented, for other orientations, such as along the (310) plane, also give useful results. The (100) orientation is additionally preferred because of the high work function resulting from its relatively dense molecular packing, and because thermal field buildup has been found to produce the greatest reduction in angular dispersion of the emitted beam. To remove any small "whiskers" that may have formed during the etching process, the tip is flashed, that is, heated at a temperature on the order of 1900°K for 0.5 seconds, several times or until a clean tungsten emission pattern is observable. The term "clean emission pattern" is widely known in the art and has a generally accepted meaning. See, for example, FIG. 1 (*a*) in the above-identified article by Swanson and Crouser.

Because adsorption varies inversely with the work function on a given surface, adsorption directly onto the emitter tip of FIG. 1 would result in a relatively heavier building up of adsorbed atoms on the rougher regions, designed by the numerals 12—12, where the relatively low atomic surface density gives the surface a lower work function than on the desired (100) plane 11, whose high atomic density gives it a high work function. During operation with this tip, surface migration of zirconium atoms away from the desired (100) plane would occur because surface tension forces from the high radius of curvature would push the atoms toward lower energy states near the shank of the tip. Hence, emission from the desired (100) plane would be even further reduced.

Figure 2:
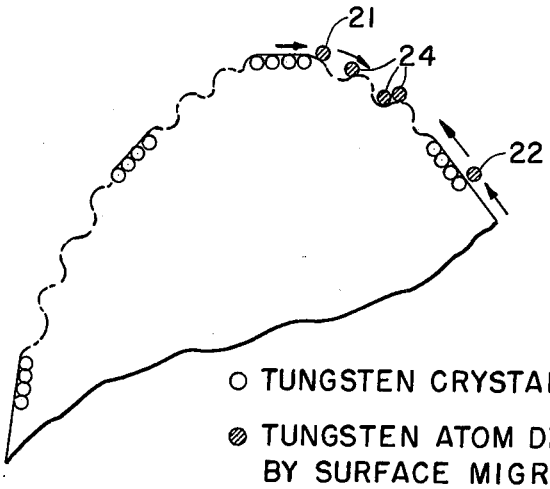
FIG. 2 is a schematic cross section of a field emitter tip showing atomic structure during the faceting process.

By selective roughing, or atomic misalignment of the tungsten lattice atoms, the work function may be altered such that adsorption is increased on the normally smooth (100) plane while adsorption is decreased on the normally rougher regions through surface migration. The surface migration from the tip to the shank may be halted by the introduction of an electrostatic field. By properly adjusting the electrostatic field, surface migration of atoms toward the shank, shown generally at 21 of FIG. 2, is stopped when the atoms reach the regions 12—12 of low atomic density (FIG. 1) immediately below the (100) plane. The same field which prohibits further surface migration from the emitter tip causes migration, shown generally at 22, from the lower regions of the shank toward the tip. This migration will be stopped by the opposing surface tension forces when the atoms reach the areas 12—12 of low atomic density. The tungsten atoms 24—24 which have migrated from their original positions in the crystal are held firmly in the regions of lower atomic density because of the lower work function there. The result is a relative building up and smoothing of the rougher regions 12—12 (FIG. 1) to create a tip surface composed of faceted planes. That is, the tip is then composed essentially of relatively smooth, planar surfaces with sharply defined edges of intersection, as shown by the numerals 31—31 in FIG. 3. In this preferred method, the voltage required to obtain a one microamp total emission is measured. The field polarity is then reversed to prevent damage to the emitter tip, and increased by approximately 30 percent over that which was required for one microamp emission. The 30 percent increase was found experimentally to produce good results. It is to be understood that varying percentages may be used to produce similar results with varying degrees of success. The tip is flashed in the presence of this electric field until emission is observable, either by measurement or observation, from the (100) plane. Often, more than one "flash" in the presence of the electric field is necessary to produce the desired emission. The surface migration of atoms caused by the combination of electrostatic field and heating pulses results in a realignment of the tip atoms to enlarge the size of the adjacent planar surfaces. This effectively smooths the previously rough regions 12—12 and reduces their sticking coefficients. Simultaneously, the electrostatic field creates an atomic misalignment of the atoms along the emitting (100) plane to reduce that plane's work function and increase its sticking coefficient. The result is shown symbolically in FIG. 3.

Figure 3:
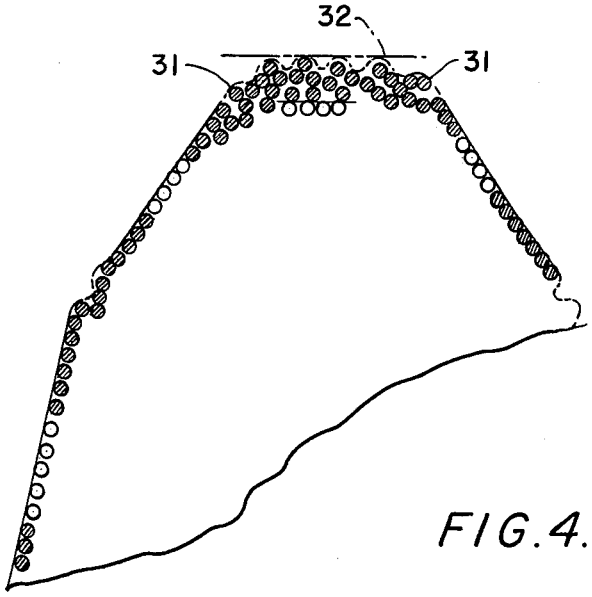
FIG. 3 is a schematic cross section of the field emitter tip showing structure after faceting.
Figure 4:
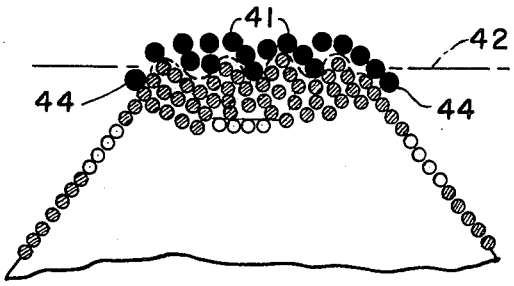
FIG. 4 is a schematic cross section of the field emitter tip showing deposition into a selected plane after faceting.

Deposition of atoms of zirconium or a similar adsorbate onto the (100) plane 32 of FIG. 3 is accomplished by any effective method such as by heating a 0.5 cm diameter loop of 8 mil tungsten wire wrapped with 5 mil zirconium wire in proximity with the emitter tip. The result is substantially as shown in FIG. 4, with a monolayer of zirconium atoms 41—41 adsorbed onto the (100) plane 42 of the tungsten crystal. Any zirconium atoms 44—44 adsorbed onto planes adjacent to the (100) plane will be loosely held because of the high work functions created on those planes, and will tend to move toward the (100) plane due to the surface migration forces. Emissions are thereby effectively restricted to the (100) plane, where the faceted edges aid in producing improved resolution and the lowered work function aids in increasing emissions for improved brightness.

The above description is of a preferred embodiment of the invention, and numerous modifications could be made thereto without departing from the spirit and scope of the invention which is limited only as defined in the appended claims.

What is claimed is:

1. A field emission tip comprising:

a base material of a single crystal metal having an emitting planar surface and a plurality of non-emitting planar surfaces, said emitting surface having a reduced work function due to misalignment of the lattice atoms of said crystal metal, said non-emitting surfaces having an increased work function due to realignment of the lattice atoms of said crystal metal, and a monolayer of metal adsorbate atoms on said emitting surface.

2. The tip of claim 1 wherein said crystal metal is tungsten.

3. The tip of claim 2 wherein said emitting surface is along the (100) plane.

4. A process for the selective deposition of a metal adsorbate onto a field emission tip of a single crystal metal comprising the steps of:

placing said tip in a suitable vacuum;

flashing said tip until said tip becomes clean;

creating an electrostatic field around said tip;

flashing said tip in the presence of said electrostatic field, thereby creating surface migration of atoms of said single crystal metal along said tip until said tip surface is composed of faceted planes, and depositing a monolayer of metal adsorbate atoms onto said tip.

5. The process of claim 1 wherein flashing said tip in the presence of an electrostatic field includes producing an emitting plane and a plurality of non-emitting planes on the surface of said tip.

6. The process of claim 5 wherein flashing said tip in the presence of an electrostatic field includes reducing the work function of the emitting planar surface of said tip.

7. The process of claim 6 wherein flashing said tip in the presence of an electrostatic field includes increasing the work function of the non-emitting planar surfaces of said tip.

* * * * *